US005613179A

United States Patent [19]

Carter et al.

[11] Patent Number: 5,613,179

[45] Date of Patent: Mar. 18, 1997

[54] FORCE APPLYING BLADE DEVICE EXHIBITING A REDUCED CREEP RATE

[75] Inventors: Daniel L. Carter, Scottsville; Geoffrey C. Williams, Penfield, both of N.Y.

[73] Assignee: Xerox Corporation, Stamford, Conn.

[21] Appl. No.: 560,234

[22] Filed: Nov. 21, 1995

[51] Int. Cl.[6] ..... G03G 15/16

[52] U.S. Cl. ..... 399/316; 267/158

[58] Field of Search ..... 355/274, 277, 355/219, 273, 299; 29/230; 267/158–164, 260, 261, 283; 399/174, 316, 274, 284

[56] References Cited

U.S. PATENT DOCUMENTS

| | | | |
|---|---|---|---|
| 4,847,652 | 7/1989 | Masuda et al. | 355/274 |
| 5,081,501 | 1/1992 | Waki et al. | 355/274 |
| 5,091,751 | 2/1992 | Inoue et al. | 355/274 |
| 5,227,851 | 7/1993 | Yoshida et al. | 355/271 |
| 5,249,022 | 9/1993 | Watanabe et al. | 355/271 |

FOREIGN PATENT DOCUMENTS

| | | | |
|---|---|---|---|
| 05061362 | 3/1993 | Japan | 355/277 |
| 06095516 | 4/1994 | Japan | 355/277 |
| 06095530 | 4/1994 | Japan | 355/277 |

*Primary Examiner*—Robert Beatty
*Attorney, Agent, or Firm*—Tallam I. Nguti

[57] ABSTRACT

A spring force applying blade device for exhibiting a reduced creep rate when bent in a force applying application. The spring force applying device includes a guide member for supporting a blade member. The guide member has a curved portion for supporting a blade member bent thereover for applying a force. The spring force applying blade device also includes a spring blade member that has a first edge that is attached to the guide member, and a second and opposite edge for applying a force when bent over the curved portion of the guide member. The blade member is comprised of a plurality of blade layers for reducing stress and for reducing a creep rate of the blade member when bent over the curved portion of the guide member in a force applying application. The plurality of blade layers are attached together at the first edge of the blade member and are free to slide relative to each other at the second and opposite edge. The plurality of blade layers have different thicknesses and wherein a layer having the least thickness is closest to the guide member. Preferably, the spring force applying blade is used to assist transferring an image in a electrostatic reproduction machine.

9 Claims, 3 Drawing Sheets

FORCE APPLYING BLADE DEVICE EXHIBITING A REDUCED CREEP RATE

BACKGROUND OF THE INVENTION

The Present Application is related in subject matter to and cross-referenced with both U.S. Pat. application Ser. No. 08/560,777 (entitled *Method and Apparatus for Pre-Creeping A Greater Than Required Strength Blade Device*) which application is attributable to the same Applicants as the Present Application, and both of which applications were filed on the same day as the Present Application.

This invention relates to flexible force applying blade devices, and more particularly to a force applying blade exhibiting a reduced creep rate, and that is usable as a relatively more precise and effective image transfer assist blade in an electrostatographic reproduction machine.

Generally, the process of electrostatographic reproduction includes uniformly charging an image frame of a moving image bearing member, or photoreceptor, to a substantially uniform potential, and imagewise discharging it or imagewise exposing it to light reflected from an original image being reproduced. The result is an electrostatically formed latent image on the image frame of the image bearing member. For multiple original images, several such frames are similarly imaged. The latent image so formed on each frame is developed by bringing a charged developer material into contact therewith. Two-component and single-component developer materials are commonly used. A typical two-component developer material comprises magnetic carrier particles, also known as "carrier beads," having fusable charged toner particles adhering triboelectrically thereto. A single component developer material typically comprises charged toner particles only.

In either case, the fusable charged toner particles when brought into contact with each latent image, are attracted to such latent image, thus forming a toner image on the image bearing member. The toner image is subsequently transferred at an image transfer station of the machine to an image receiver copy sheet. The copy sheet is then passed through a fuser apparatus where the toner image is heated and permanently fused to the copy sheet to form a hard copy of each of the original images.

In some electrostatographic reproduction machines, it is well known to use a curved or bent single layer blade device for applying a force to the backside of the copy sheet in order to assist image transfer from an image bearing member to the copy sheet. A conventional single layer force applying transfer assist blade as such unfortunately has a relatively short life in the reproduction machine due to its creep or nonrecoverable plastic deformation rate, and hence must be replaced frequently in order to prevent image deletions or transfer failures.

SUMMARY OF THE INVENTION

In accordance with one aspect of the present invention, there is provided a spring force applying blade device for exhibiting a reduced creep rate when bent in a force applying application. The spring force applying device includes a handle member, and a guide member mounted to the handle member. The guide member has a curved portion for supporting a blade member when bent thereover for applying a force. The spring force applying blade device also includes a spring blade member that has a first edge that is attached to the guide member, and a second and opposite edge for applying a force when bent over the curved portion of the guide member. The blade member is comprised of a plurality of blade layers for reducing a creep rate of the blade member when bent over the curved portion of the guide member in a force applying application. The plurality of blade layers are attached together at the first edge of the blade member.

Pursuant to another aspect of the present invention, there is provided an electrostatographic reproduction machine including an image bearing member, apparatus for forming a latent image on the image bearing member, a development station for developing the latent image with toner to form a toner image, and a transfer station for transferring the toner to a copy sheet. The transfer station includes a flexible spring blade device having a blade member for applying an image transfer assist force to the backside of the copy sheet. The blade member is comprised of a plurality of blade layers for significantly reducing the level of stress in each blade layer, and the creep rate of the blade member during use as a transfer assist blade.

Other features of the present invention will become apparent from the following drawings and description.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic reproduction is well known, the various processing stations employed in the FIG. 4 reproduction machine will be shown hereinafter schematically and their operation described briefly with reference thereto.

Figure 4:
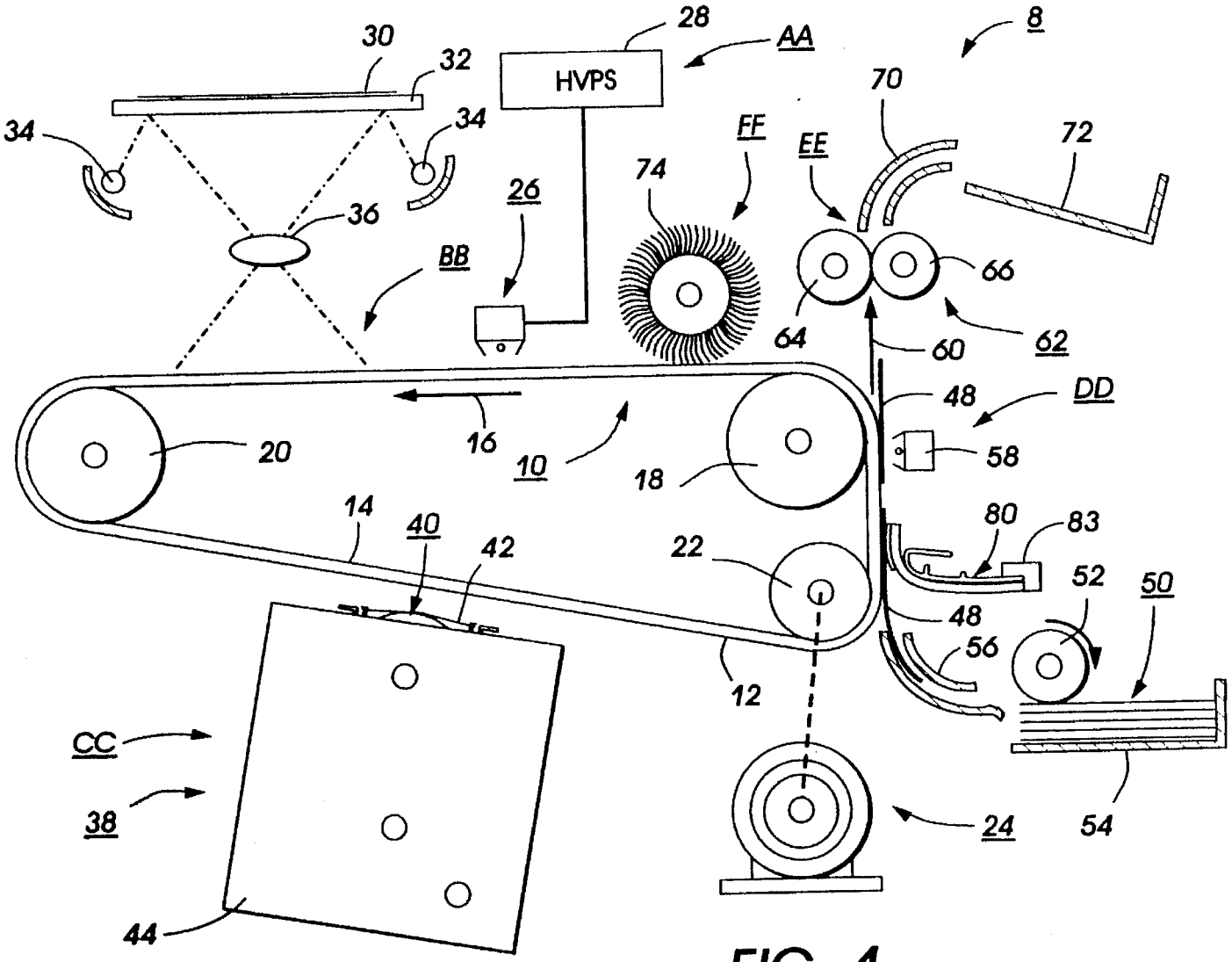
FIG. 4. is a schematic elevational view of an illustrative electrostatographic reproduction machine incorporating the reduced creep rate force applying blade device of the present invention as a transfer assist blade.

Referring initially to FIG. 4, there is shown an illustrative electrophotographic or electrostatographic reproduction machine incorporating the development apparatus of the present invention therein. The electrophotographic reproduction machine employs a belt 10 having an image bearing surface 12 deposited on a conductive substrate 14. Preferably, image bearing surface 12 is made from a selenium alloy. Conductive substrate 14 is made preferably from an aluminum alloy which is electrically grounded. Belt 10 moves in the direction of arrow 16 to advance successful portions of image bearing surface 12 sequentially through the various processing stations disposed about the path of movement thereon. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station AA. At charging station AA, a corona generating device, indicated generally by the reference numeral 26, charges image bearing surface 12 to a relatively high, substantially uniform potential. High voltage power supply 28 is coupled to corona generating device 26. Excitation of power supply 28 causes corona generating device 26 to charge image bearing surface 12 of belt 10. After image bearing surface 12 of belt 10 is charged, the charged portion thereof is advanced through exposure station BB.

At exposure station BB, an original document 30 is placed face down upon a transparent platen 32. Lamps 34 flash light rays onto original document 30. The light rays reflected from original document 30 are transmitted through lens 36 to form a light image thereof. Lens 36 focuses the light image onto the charged portion of image bearing surface 12 to selectively dissipate the charge thereon. This records an electrostatic latent image on image bearing surface 12 which corresponds to the informational areas contained within original document 30. One skilled in the art will appreciate that in lieu of a light lens system, a raster output scanner may be employed. The raster output scanner (ROS) uses a modulated laser light beam to selectively discharge the charged image bearing surface 12 as to record the latent image thereon. In the event a reproduction system is being employed, the modulation of the ROS is controlled by an electronic subsystem coupled to a computer. Alternatively, in the event a digital copier is being used, a raster input scanner may scan an original document to convert the information contained therein to digital format which, in turn, is employed to control the ROS.

After the electrostatic latent image has been recorded on image bearing surface 12, belt 10 advances the latent image to development station CC. At development station CC, a developer unit, indicated generally by the reference numeral 38, develops the latent image recorded on the image bearing surface. Preferably, developer unit 38 includes donor roller 40 and electrode wires 42. Electrode wires 42 are electrically biased relative to donor roll 40 to detach toner therefrom so as to form a toner powder cloud in the gap between the donor roll and the image bearing surface. The latent image attracts toner particles from the toner powder cloud forming a toner powder image thereon. Donor roller 40 is mounted, at least partially, in the chamber of developer housing 44. The chamber in developer housing 44 stores a supply of developer material. The developer material is two component developer material having at least carrier granules with toner particles adhering triboelectrically thereto. A magnetic roller disposed interiorly of the chamber of housing 44 conveys the developer material to the donor roller. The magnetic roller is electrically biased relative to the donor roller so that the toner particles are attracted from the magnetic roller to the donor roller.

With continued reference to FIG. 4, after the electrostatic latent image is developed, belt 10 advances the toner powder image to transfer station DD. A copy sheet 48 is advanced to transfer station DD by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with image bearing surface 12 of belt 10 in a timed sequence so that the toner powder image developed thereon contacts the advancing sheet at transfer station DD. Transfer station DD includes a corona generating device 58 which sprays ions onto the backside of sheet 48. This attracts toner particles forming the toner powder image from image bearing surface 12 to sheet 48.

More importantly, transfer station DD includes the reduced creep rate multiple layer transfer assist blade device 80 of the present invention (to be described in detail below). The transfer assist blade device 80 as mounted within the machine 8 is adjustable in and out relative to the copy sheet 48 by and an actuator device 83 so that it applies a uniform force or load to the backside of a copy sheet 48 moving through the transfer station DD. The force or load thus applied must be precise and uniform in order to effect quality image transfer without stalling of the copy sheet and smearing of the image, or without image deletions.

After such transfer, sheet 48 continues to move in the direction of arrow 60 onto a conveyor (not shown) which advances sheet 48 to fusing station EE. Fusing station EE includes a fuser assembly indicated generally by the reference numeral 62 which permanently affixes the transferred powder image to sheet 48. Fuser assembly 62 includes a heated fuser roller 64 and back-up roller 66. Sheet 48 passes between fuser roller 64 and backup roller 66 with the toner powder image contacting fuser roller 64. In this manner, the toner powder image is permanently affixed to sheet 48. After fusing, sheet 48 advances through chute 70 to catch tray 72 for subsequent removal from the reproduction machine by the operator.

After the the copy sheet is separated from image bearing surface 12 of belt 10, the residual toner particles adhering to image bearing surface 12 are removed therefrom at cleaning station FF. Cleaning station FF includes a rotatably mounted fibrous brush 74 in contact with image bearing surface 12. The particles are cleaned from image bearing surface 12 by the rotation of brush 74 in contact therewith. Subsequent to cleaning, a discharge lamp (not shown) floods image bearing surface 12 with light to dissipate any residual electrostatic charge remaining thereon prior to the charging thereof for the next successive imaging cycle.

Figure 1:
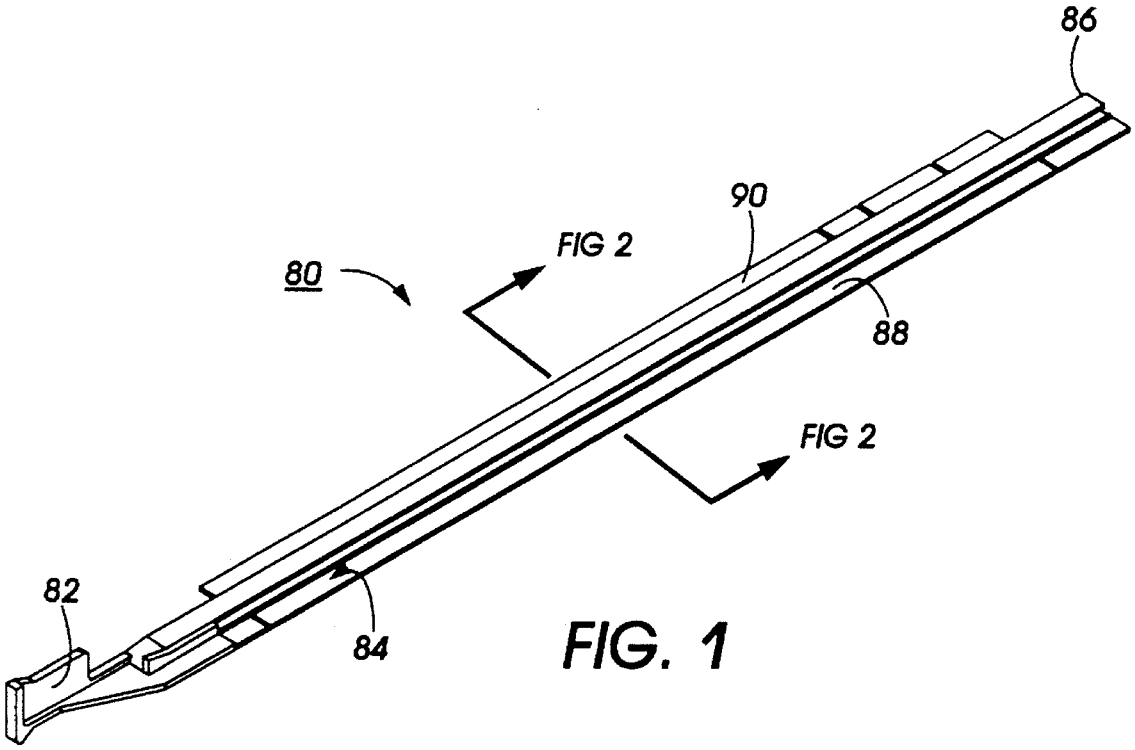
FIG. 1 is an isometric view of the reduced creep rate force applying multiple layer blade device of the present invention.
Figure 2:
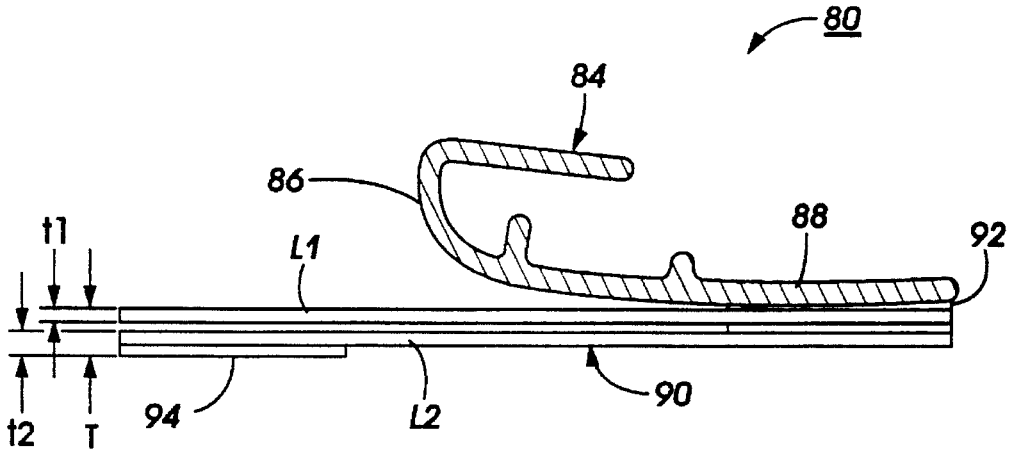
FIG. 2 is a cross-section of the blade device of FIG. 1 taken along the view line 2—2.
Figure 3:
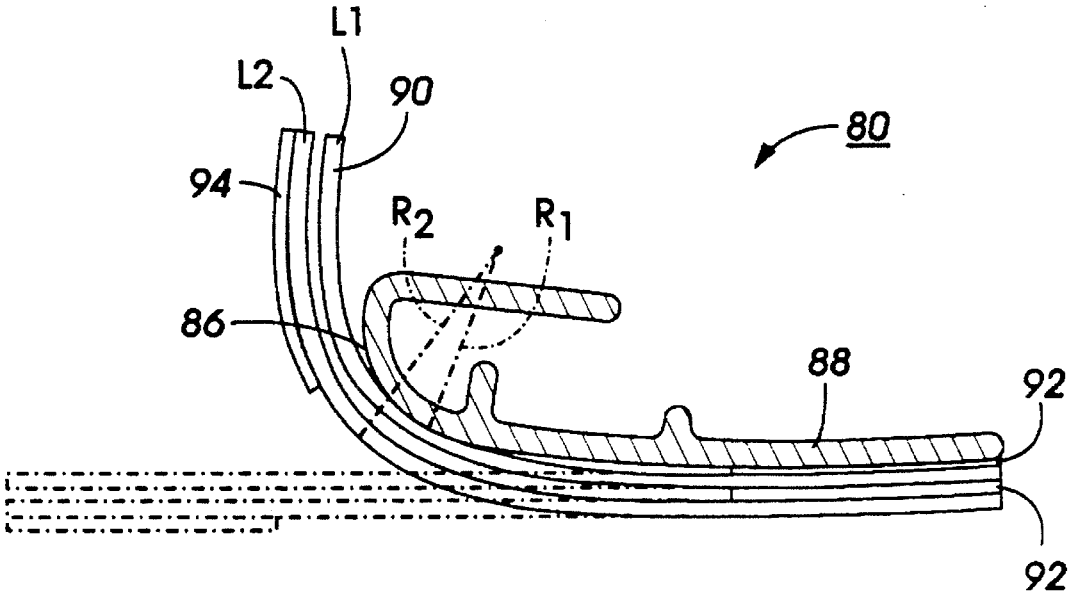
FIG. 3 is a sectional illustration of the blade device of FIG. 2 curved or bent into a force applying position.

Referring now to FIGS. 1 to 3, the reduced creep rate force applying multiple layers blade device 80 of the present invention is illustrated in detail. As shown, the force applying blade device 80 includes a handle member 82 and a blade guide member 84 that is preferably made from a plastic material, and has a blade bending curved portion 86 with a radius of about 3 mm. The guide member 84 can also be made of metal, or of fiberglass. In any case, the guide member 84 functions to hold and secure a blade member 90 of the present invention, as the blade member is bent or curved over curved portion 86 for evenly contacting the back of a copy sheet 48. The guide member 84 is designed so as to minimize stress concentration in a particular point of the blade member when the blade member 90 is bent around the curved portion 86 thereof the device 80 is mounted to push against the backside of the copy sheet 48 so as to remove any air gaps between the copy sheet 48 and image bearing surface 12, thereby enabling uniform image transfer without image deletions that would otherwise occur due to such air gaps.

The blade member 90 can be attached to the guide member 84 using adhesive shown as 92, for example. The guide member 84 may be assembled to the handle 82 that is then mounted within a machine 8, so that the blade member 90 can be moved, as well as adjusted in and out relative to the image bearing surface 12 or to a plane of image transfer. The in and out adjustment of the blade member 90 is such as to prevent damage by a blade member 90 to the photoreceptor or image bearing member at times when there is no copy sheet at the transfer station DD. The in and out adjustment on the other hand is also necessary because the blade member 90 as bent or curved about the curved portion 86, invariably tends to further creep or relax during use in this application process, and thus its resulting generated force also tends to drop off proportionally with such further in process creeping or relaxation.

The blade member 90 of the present invention importantly is comprised of multiple layers shown as L1, L2 (FIGS. 2 and 3), but can be any number of layers L1, L2 . . . Ln (not shown) so as to reduce the stress in each layer. "Stress" as used here refers to the internal reaction of the blade layer or member to an applied bending force. Importantly too, in accordance with the present invention, the layers L1, L2 or L1, L2 . . . Ln (not shown) each have a thickness that is preferably different from each of the other thicknesses. For example, a two layer blade as illustrated may have a 0.003" first layer shown as L1, and a 0.005" second layer shown as L2, that is thicker than the first layer L1. Some of the blade layers of a multiple layer blade could also have equal thicknesses.

Even more importantly in accordance with the present invention, the multiple layers L1, L2 or (L1, L2 . . . Ln not shown) of the blade member 90 are preferably arranged and assembled together in order of layer thickness, starting for example with the thinnest layer, and increasing in order of thickness to the thickest layer. In general, multiple layers L1, L2 . . . Ln arranged as such, are preferably then attached to the guide member 84 such that the thinnest layer thereof is closest to the curved portion 86 of the guide member 84. In other words, the arranged layers are attached to the guide member such that when the blade member 90 is flexed into a curve or bent around the curved portion 86 of the guide member 84, the thinnest layer thereof is brought into contact or into near contact with the curved portion 86. As illustrated, there can be as few as two (2) layers, or as many layers as are desired, depending on the range of applied forces desired over the blade life, and depending on the approximate overall thickness of a blade member that is necessary, given other blade material characteristics.

The blade or layer material is preferably polyester, but it could also be metal, a different plastic, fiberglass, beryllium, or copper. A metallic blade member for the same application process would of course be thinner than one made from plastic.

The different layers such as L1, L2 should be assembled together into the blade member 90, for example, by being glued together at a first edge using an adhesive material, The blade member 90 is then attached to the flat portion 88 of the guide member 84 as shown. The blade member 90 can be attached as such using the same adhesive material 92 or alternatively, it can be attached by heat staking, or by using staples, bolts, screws, rivets or the like. If staples, heat stakes, bolts, screws, or rivets are used, the overall thickness "T" of the blade member 90 could be reduced relative to the same blade member being assembled using adhesive between its layers. This could be important in tight areas. In any case, the layers and the blade member should be so attached such that the attached portions should be fixed relative to the guide member and to each other at one end, and should slide relative to each other at the opposite end.

Stress is directly proportional to creep (as defined above), and in a bent or curved blade layer or member, it is determined by the ratio of the thickness of the blade member to the radius of curvature of the blade member in a force application. Thus in order to reduce stress and hence the creep rate of each layer in accordance to the present invention, it is important that the thinnest layer should be assembled so as to have the smallest radius of curvature when the blade layers are deflected or curved backwards for applying the desired forces. This is because the blade member usually is bent backwards for its front layer to contact the backside of a copy sheet, and thus the thinnest layer should be the back layer or layer furthest away from the copy sheet.

Accordingly, in the two layer blade example above, when the blade member thereof is attached to the guide member 84, the thinner (0.003") first layer blade is attached to the holder and guide member, and has the smaller radius of curvature R1 compared to that R2 of the thicker (0.005") second layer. In general, a multiple layer blade member arranged in order of increasing layer thickness should be attached to the guide member so that the thinnest layer is to the inside of a blade curve or bend so as to have the smallest radius of curvature R1 when the blade member is bent for force application. As such, the thickest layer will be to the outside of the curvature and will have the largest radius of curvature RN, and hence less stress in such layer.

It has been found that given a particular curved or bent blade application, the level of stress in a blade member is directly proportional to thickness of the blade member multiplied by the stress concentration factor. So, the less the thickness of the blade member, the less the level or value of stress in such member. This is true where as according to the present invention, the blade layer is one of but several layers forming the bent or curved force applying blade member.

The blade device 80 further includes a skid member 94 that is attached to the tip end of the front of the thickest layer for contacting and riding against the backside of the copy sheet 48. The skid member 94 preferably is made of a high density material such as plastic, steel or, brass, and should be relatively thin and flexible so as to make good and uniform contact with the copy sheet. It may also be formed in the form of rollers for best wear characteristics in such use.

The equations or formulas for a cantilever generally rectangular plastic spring blade device shows that a change in the thickness of the blade changes the applied force by its cube. As illustrated below, where "F" is force applied; "L" is the length of the force arm; "E" is a modulus of elasticity; "I" is a moment of inertia; "b" is is the with of the generally rectangular blade member; "h" is a thickness of blade member, "d" is the deflection of the blade member under force "F"; "s" (sigma) is the stress in the blade member under force "F"; and "k" is a stress concentration factor (equal approximately to one plus one-half a ratio of the thickness "h" to a radius of curvature of the blade member when applying the force "F"); the applicable equations are as follows:

$$\text{"d"}=(FL^3)/(3EI), \text{ or "d"}=(4FL^3)/(Ebh^3);$$

and $$\text{"s"}=(mck)/I, \text{ or "s"}=(6FLk)/(bh^2)$$

So $$\text{"F"}=(dEbh^3)/(4L^3) \quad (1)$$

and $$"s"=(3dEh)k/(2L^2) \quad (2)$$

Accordingly, it can be seen that "s" or stress is proportional to "h" (thickness) multiplied by "k", and "F" (force) is proportional to "h3" (h cubed). Thus reducing the thickness "h" of a blade member or blade layer will result in a significant drop or reduction in the force produceable and in the stress level of the blade or layer, all else being equal in a given application. A reduction in the stress level thus results in a reduction in the creep rate, and hence in a longer blade life.

To recapitulate, the present invention is directed to an electrostatographic process reproduction machine that includes an image bearing member 10 that is movable along a process path, apparatus located along the process path for forming a latent image on the image bearing member, and a development station CC for developing the latent image with fusable toner particles to form a toner image. The reproduction machine also includes a transfer station DD for transferring the toner image onto a supplied copy sheet 48. The transfer station includes the force applying image transfer assist blade device 80 for contacting a backside of the copy sheet 48 to apply a uniform and precise image transfer assist force. The transfer assist blade device 80 has a handle 82 that is located along the process path and is adjustable relative to the image bearing member. The transfer assist blade device 80 also includes a guide member 84 that is mounted to the handle 82 and has a curved portion 86 thereof for supporting a bent blade member thereover.

The blade device 80 further includes a bent blade member 90 that is attached to the flat portion 88 of the guide member 84, and is bent around the curved portion 86 of the guide member. The bent blade member 90 importantly is comprised of a plurality of layers L1, L2 or L1, L2 . . . LN (not shown) so as to reduce stress in each layer and an overall creep rate of the bent blade member 90 at the transfer station DD.

Each blade layer L1, L2, for example, of the plurality of blade layers has a thickness "t1", "t2" that is different from or is the same as, the thickness of each layer of the rest of the plurality of blade layers. Each blade layer of the plurality of blade layers is arranged in order of thickness relative to an adjacent blade layer, and the plurality of blade layers are attached in a cantilevered manner to the guide member 84 at a first edge of the blade member 90. The plurality of blade layers more specifically is arranged in order of increasing thickness, and is attached to the guide member such that when the layers are curved or bent over the curved portion 86 for applying a force, the thickest layer thereof has the greatest radius of curvature, and the thinnest layer has the least radius of curvature. This is in order to reduce the level of stress in each layer, and hence significantly reduce the creep rate, and increase the life of the blade member.

A skid member 94 is attached to a second edge of an outside surface of an outmost blade layer of the plurality of blade layers, for contacting and riding on a surface that receives a force being applied by the blade member 90. Blade layers of the plurality of blade layers are unattached and are free to slide relative to one another at the second edge.

Testing has shown that bent or curved force applying blades having multiple layers exhibit a relatively lower rate of creep or relaxation due to stress when compared to comparable single layer blades, and hence would have a relatively improved or longer blade life than single layer blades under the same or similar application process conditions.

It is, therefore, apparent that there has been provided in accordance with the present invention, a force applying blade device that has multiple layers for reduced stress and a reduced creep rate for fully satisfying the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An electrostatographic process reproduction machine comprising:

(a) an image bearing member movable along a process path;

(b) means located along the process path for forming a latent image on said image bearing member;

(c) a development station along the process path for developing the latent image with fusable toner particles to form a toner image; and (d) a transfer station for transferring the toner image onto a copy sheet, said transfer station including a force applying image transfer assist blade device for contacting a backside of the copy sheet to apply a uniform image transfer assist force, said transfer assist blade device having:

(i) a handle located along the process path, said handle being adjustable relative to said image bearing member;

(ii) a guide member mounted to said handle and including a curved portion for supporting a bent portion of said blade member; and (iii) a flexible blade member attached to said guide member and bent around said curved portion of said guide member, said flexible blade member being comprised of a plurality of blade layers having different thicknesses and including a least thickness blade layer having a least radius of curvature of said plurality of blade layers, when bent around said curved portion of said guide member, so as to reduce stress in each layer of said plurality of blade layers, and so as to reduce an overall creep rate of said flexible blade member at said transfer station.

2. A spring force applying blade device for exhibiting a reduced creep rate when bent in a force applying application, the blade device comprising:

(a) a guide member including a curved portion for supporting a blade member when the blade member is bent around said guide member; and (c) a spring force applying blade member having a first edge attached to said guide member, and a second and opposite edge for applying a force when bent over said curved portion of said guide member, said blade member being comprised of a plurality of blade layers so as to reduce stress, and a creep rate, of said blade member when bent over said curved portion in a force applying application, and said plurality of blade layers including a least thickness layer, and being attached together at said first edge of said blade member such that said least thickness layer is closest to said guide member.

3. The spring force applying blade device of claim 2, wherein each blade layer of said plurality of blade layers has a thickness different from a thickness of each of a rest of said plurality of blade layers.

4. The spring force applying blade device of claim 2, wherein said plurality of blade layers is attached at said first edge of said blade member in a cantilevered manner to said guide member.

5. The spring force applying blade device of claim 2, including a skid member, attached to a tip portion at a second edge of an outside surface of an outmost blade layer of said plurality of blade layers, for contacting and riding on a surface for receiving a force being applied by said blade member.

6. The spring force applying blade device of claim 3, wherein said each blade layer of said plurality of blade layers is arranged in order of thickness relative to an adjacent blade layer.

7. The spring force applying blade device of claim 4, wherein blade layers of said plurality of blade layers are unattached and free to slide relative to one another at said second edge.

8. The spring force applying device of claim 6, wherein said plurality of blade layers is arranged in order of increasing thickness, and is attached to said guide member such that when curved over said curved portion of said guide member for applying a force, each relatively thicker layer thereof has a relatively greater radius of curvature than each relatively thinner layer.

9. A spring force applying blade member comprising:

(a) a first edge for attaching to a guide member;

(b) a second and opposite edge for applying a force when bent around a curved portion of the guide member; and (c) a desired blade member thickness, said desired blade member thickness including a plurality of blade layers for reducing stress in, and a creep rate of, the blade member when said plurality of blade layers are bent over the curved portion of the guide member in a force applying application, said plurality of blade layers having different thicknesses and including a least thickness layer, and said plurality of blade layers being attached together at said first edge of the blade member such that said least thickness layer is closest to the guide member, and such that each blade layer of said plurality of blade layers is free to slide relative to each other at said second and opposite edge.

* * * * *